US007052476B2

(12) United States Patent
Kim

(10) Patent No.: US 7,052,476 B2
(45) Date of Patent: May 30, 2006

(54) LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 405 days.

(21) Appl. No.: 10/622,208

(22) Filed: Jul. 18, 2003

(65) Prior Publication Data

US 2005/0015029 A1 Jan. 20, 2005

(51) Int. Cl.
*A61H 15/00* (2006.01)

(52) U.S. Cl. ..... 601/99; 601/103; 601/116; 601/126

(58) Field of Classification Search ..... 601/15, 601/17–19, 84, 86–88, 90–96, 97–99, 100–103, 601/105, 115, 116, 122, 126; 606/240–242
See application file for complete search history.

(56) References Cited

U.S. PATENT DOCUMENTS

| | | | | |
|---|---|---|---|---|
| 2,193,882 | A | 3/1940 | Petersen | |
| 2,310,106 | A | 2/1943 | Miller | |
| 2,359,933 | A | 10/1944 | Niblack | |
| 2,781,040 | A | 2/1957 | Hill | |
| 2,874,689 | A | 2/1959 | Gavelek | |
| 2,909,173 | A | 10/1959 | Anderson | |
| 3,687,133 | A | 8/1972 | Grubelic | |
| 3,877,422 | A | 4/1975 | Heuser et al. | |
| 4,190,043 | A | 2/1980 | Thompson | |
| 4,422,449 | A | 12/1983 | Hamabe | |
| 4,458,675 | A | 7/1984 | Nakao et al. | |
| 4,586,493 | A | 5/1986 | Goodman | |
| 4,656,998 | A | 4/1987 | Masuda et al. | |
| 4,899,403 | A | 2/1990 | Yamasaki | |
| 4,947,833 | A | 8/1990 | Yamasaki | |
| 5,038,757 | A | 8/1991 | Yamasaki | |
| 5,088,475 | A | 2/1992 | Steffensmeier | |
| 5,101,835 | A * | 4/1992 | DelRe | 601/122 |
| 5,165,390 | A | 11/1992 | Fleetwood | |
| 5,179,940 | A | 1/1993 | Barreiro | |
| 5,755,677 | A | 5/1998 | Masuda et al. | |
| 5,807,288 | A | 9/1998 | Wu | |
| 6,071,252 | A | 6/2000 | Marcantoni | |
| 6,190,338 | B1 | 2/2001 | Arndt | |
| 6,224,563 | B1 | 5/2001 | Nonoue et al. | |
| 6,243,609 | B1 | 6/2001 | Lee | |
| 6,409,689 | B1 | 6/2002 | Chen | |
| 6,454,732 | B1 | 9/2002 | Lee | |
| 6,542,779 | B1 | 4/2003 | Lee | |
| 6,555,798 | B1 | 4/2003 | Lee | |
| 6,629,939 | B1 | 10/2003 | Jikiba | |
| 6,643,551 | B1 | 11/2003 | Park | |
| 6,752,772 | B1 * | 6/2004 | Kahn | 601/98 |
| 6,911,012 | B1 * | 6/2005 | Kahn | 601/99 |
| 2002/0138023 | A1 | 9/2002 | Kume et al. | |
| 2002/0193713 | A1 | 12/2002 | Lee | |
| 2003/0018284 | A1 | 1/2003 | Lim | |

* cited by examiner

*Primary Examiner*—Quang D. Thanh
(74) *Attorney, Agent, or Firm*—Park Law Firm; John K. Park

(57) ABSTRACT

A lie-down massager includes a base frame having an elongated top panel, through which an elongated top opening is formed, a rider, a guide member movably engaged between the base frame and the rider so as to enable the rider to make a horizontally reciprocal movement, massage bumps that move vertically and/or horizontally along the elongated top opening of the elongated top panel of the base frame, and a lifter that holds the massage bumps and adjusts the height of the massage bumps. Air shock absorbers are provided between the massage bumps and the lifter so that movement of the massage bumps by the rider and the lifter is flexible and more adapted to human body contour.

17 Claims, 9 Drawing Sheets

LIE-DOWN MASSAGER

BACKGROUND OF THE INVENTION

The invention relates generally to a massaging device. More particularly, the present invention relates to an improved lie-down massager capable of efficiently treating bodily malfunctions such as back pain and gastrointestinal weakness by applying a therapeutic massaging treatment along the back and neck of a patient lying down on the massager whose massaging bumps move horizontally and vertically along the patient's spinal cord and neck while the vertical movement of the massaging bumps are compensated and smoothed by air shock actuators.

Conventional bed or mat type massaging devices employ a spring mechanism for vertically moving massaging bumps. As disclosed U.S. Pat. No. 6,454,732, a spring mechanism allows the massaging bumps to gently move up and down. However, when it comes to therapeutic effects, the spring mechanism proves too soft to push up the massaging bumps when stronger pressure is required, because tension of springs applies equally to patients lying on the massaging device regardless of patient's requirements.

A demand is to adopt a reliable mechanism demonstrating a steady and robust therapeutic effects while stabilizing the vertical movement of the massaging bumps.

SUMMARY OF THE INVENTION

The present invention is contrived to overcome the conventional disadvantages. Accordingly, an object of the invention is to provide a lie-down massager that improves therapeutic effects by adopting air shock absorbers for compensating vertical movement of massaging bumps. Another object is to improve product reliability and customer satisfaction by mechanically stabilizing the vertical movement of the massaging bumps.

To achieve these and other objects, the lie-down massager according to the present invention includes a base frame having an elongated top panel, through which an elongated top opening is formed centrally and lengthwise, a rider provided below the elongated top panel of the base frame, a guide member movably engaged between the base frame and the rider so as to enable the rider to make a horizontally reciprocal movement relative to the base frame, a lifter, one or more air shock absorbers, massage bumps attached on the lifter via the air shock absorbers and moved by the lifter vertically and/or horizontally along the elongated top opening of the elongated top panel of the base frame, and a pad covering the massage bumps and the elongated top opening of the base frame.

The lifter includes a top plate, a bottom plate, a vertical actuator that moves the top plate up and down.

A massage plate is provided. The massage bumps are installed on the massage plate, and the air shock absorbers are vertically installed between the massage plate and the top plate.

Each of the air shock absorbers has a hollow cylinder, a plunger that is moved reciprocally in the cylinder, a shaft fixed to the plunger and protruding out of the cylinder and a bracket. The free end of the shaft is shaped as a ball, and the bracket has a semi-spherical recess so that so that the end of the shaft and the recess of the bracket form a ball and socket joint. The cylinder is fixed to the top plate, and the bracket is fixed to the massage plate.

Preferably, the number of the air shock absorbers is four, and the air shock absorbers are positioned near the four corners of the rectangular top plate.

The massage bumps are partitioned to first and second pairs, and the first pair bumps are aligned parallel to the second pair bumps. The massage bump includes a heater that is a heating lamp generating heat and infrared rays.

First and second bump holders are provided for propping and maintaining the first and second pair bumps above the top portion of the lifter. The first and second bump holders are tapered toward each lower end thereof. Also a first engagement member to rockingly engage the lower ends of the bump holders to the top portion of the lifter, and a second engagement member to rollingly engage the massage bumps thereto are provided. The massage bumps are roller balls that are formed of jade.

Alternatively, the massage bumps are provided as round projections that are fixed to the top upper surface portion of the lifter.

The guide member includes one or more roller gear engaged to and powered by a roller gear motor, and one or more side rack gears parallel to each other and provided lengthwise in the base frame. The roller gear motor is fixed to the rider, and the roller gears are rollably connected to the rider and rotatably mounted on the side rack gears.

Alternatively, the guide member includes rider guide rollers provided on each side of the rider, and a pair of pulleys linked by a rope and respectively mounted in a front end portion and a rear end portion of the base frame. The rider guide rollers are rollably engaged to the base frame to guide a horizontally reciprocal movement of the rider. A predetermined portion of the rope is fixedly attached to the rider so that the pulley rotation enables the rider to generate a horizontally reciprocal movement of the rider. The pulleys are relatively twisted by 90 degrees against each other.

The lie-down massager further includes a pair of roller coasters parallel to each other, and coaster guide rollers formed outwardly extending from each side of the lifter. The roller coasters are attached to the base frame, and each of the roller coasters has a substantially waved top surface. The coaster guide rollers enable the coasting member to make a roller coasting movement on and along the waved top surfaces of the roller coasters. Each of the waved top surfaces of the roller coasters substantially forms a curvature of a human spinal cord.

The bottom plate of the lifter further includes a plurality of elongated guides extending downward, and the rider further has a plurality of guide bushes upwardly formed on the rider to releasably receive the elongated guides so as to stabilize the roller coasting movement of the lifter along the roller coasters. The elongated guides are shaped in pins.

Advantages of the present inventions include that: (1) the air shock absorbers provides massaging motions that are flexible and adapted to the body contour of the user; (2) the air shock absorber provides smooth and quite operation of the lifter; and (3) the coasting member working with the roller coasters to realize an additional lifting by utilizing the horizontally reciprocal movement of the rider enables the massaging bumps to continue a smooth, steady and robust massaging on the patient, thereby substantially improving massaging effect and subsequently maximizing customer satisfaction.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
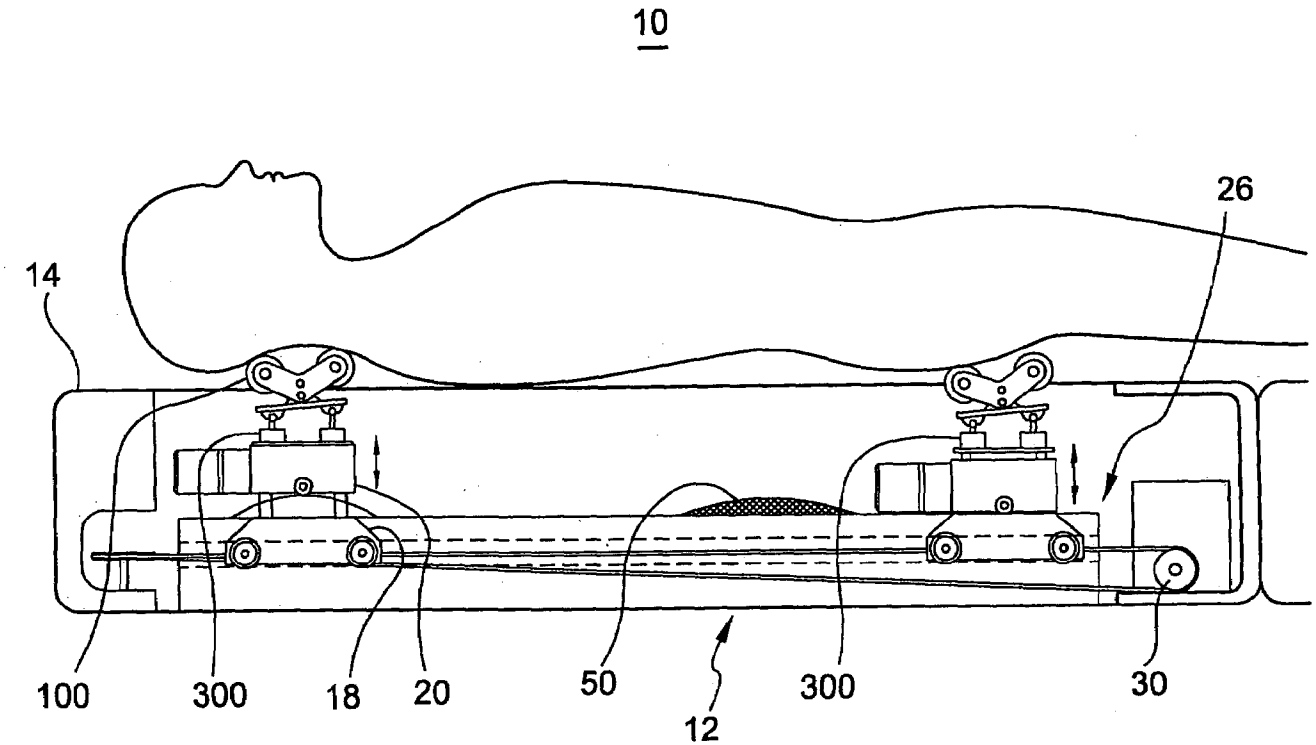
FIG. 1 is a view showing a lie-down massager with a patient lying thereon according to the present invention.
Figure 2:
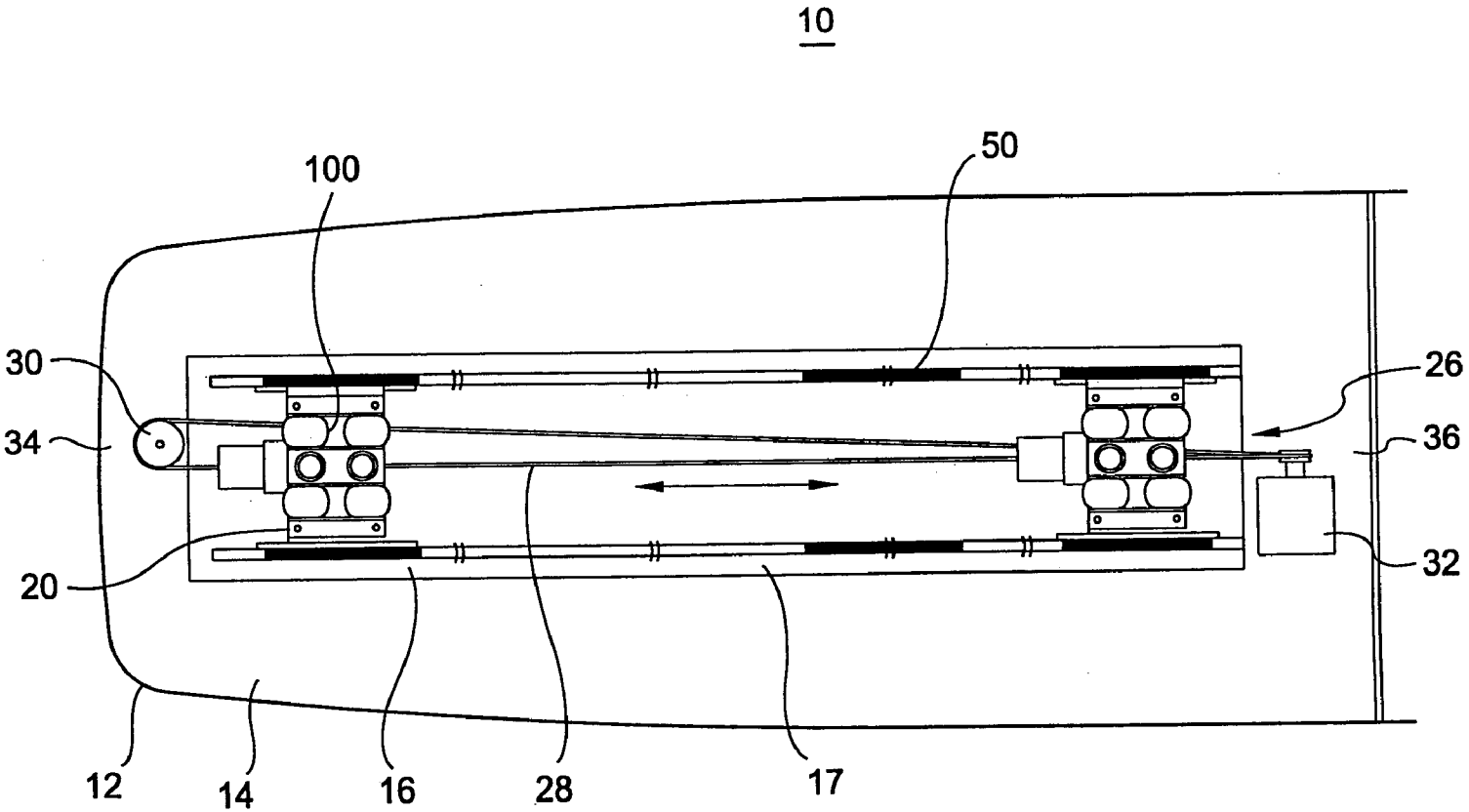
FIG. 2 is a plan view showing the lie-down massager without the patient in FIG. 1.

FIG. 1 shows a brief massaging mechanism of a lie-down massager 10 according to the present invention with a patient lying thereon for a bodily massage, and FIG. 2 shows a plan view of the massager 10 excluding the patient. As shown therein, the lie-down massager 10 includes a base frame 12 in a bed type or a mat type. The base frame 12 includes an elongated top panel 14, and an elongated opening 16 is formed centrally and lengthwise through the elongated top panel 14. The massager 10 includes a rider 18 and a lifter 20. The rider 18 is provided below the elongated top panel 14 of the base frame 12.

In order to implement the horizontal reciprocation of the rider 18, there is provided a guide member 26 movably engaged between the base frame 12 and the rider 18 so as to enable the rider 18 to make a horizontally reciprocal movement relative to the base frame 12. Here, it is recommended that the guide member 26 be either a rope-pulley application or a rack gear application.

Massage bumps 100 are attached on the lifter 20 via one or more air shock absorbers 300 and are moved by the lifter 20 vertically and/or horizontally along the elongated top opening 16 of the elongated top panel 14 of the base frame 12.

Figure 3:
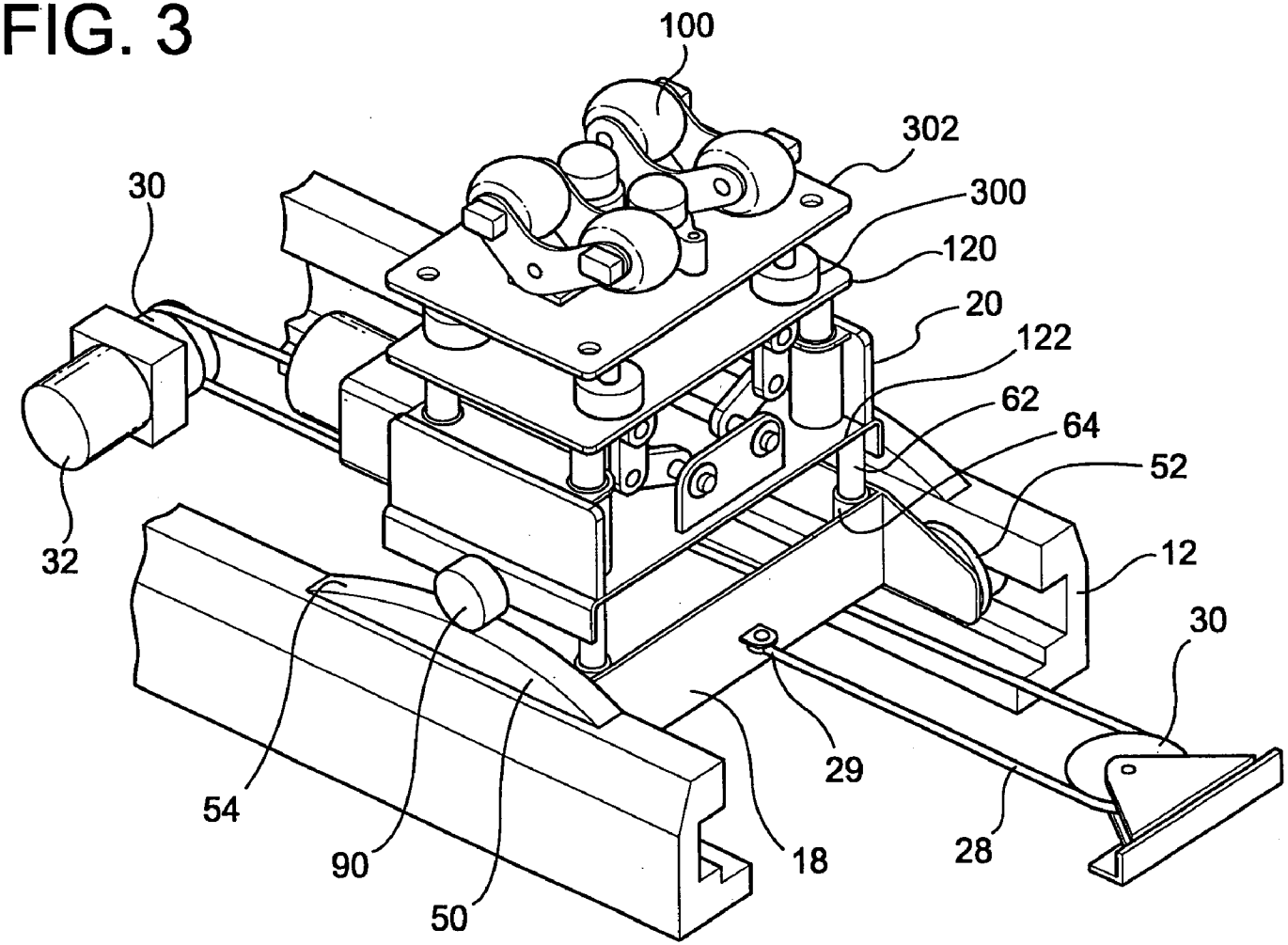
FIG. 3 is a partial perspective view showing an overall mechanism of the lie-down massager according to a first embodiment of the present invention.

As shown in FIG. 2 together with FIG. 3, the guide member 26 according to the rope-pulley application includes a rope 28, a pair of pulleys 30 and a pulley motor 32 that controls one of the pulleys 30. The pulleys 30 are linked by the rope 28 and respectively mounted in a front end portion 34 and a rear end portion 36 of the base frame 12. In a preferred version, the pulley motor 32 is provided adjacent to the pulley 30 provided in the rear end portion 36 of the base frame 12. In this construction, a predetermined portion 29 of the rope 28 is fixedly attached to the rider 18 so that the pulley rotation enables the rider 18 to generate a horizontally reciprocal movement of the rider 18. Preferably, the pulleys 30 are relatively twisted by 90 degrees against each other to facilitate the horizontal reciprocation of the rider 18 while improving controllability of the rider reciprocation.

Figure 4:
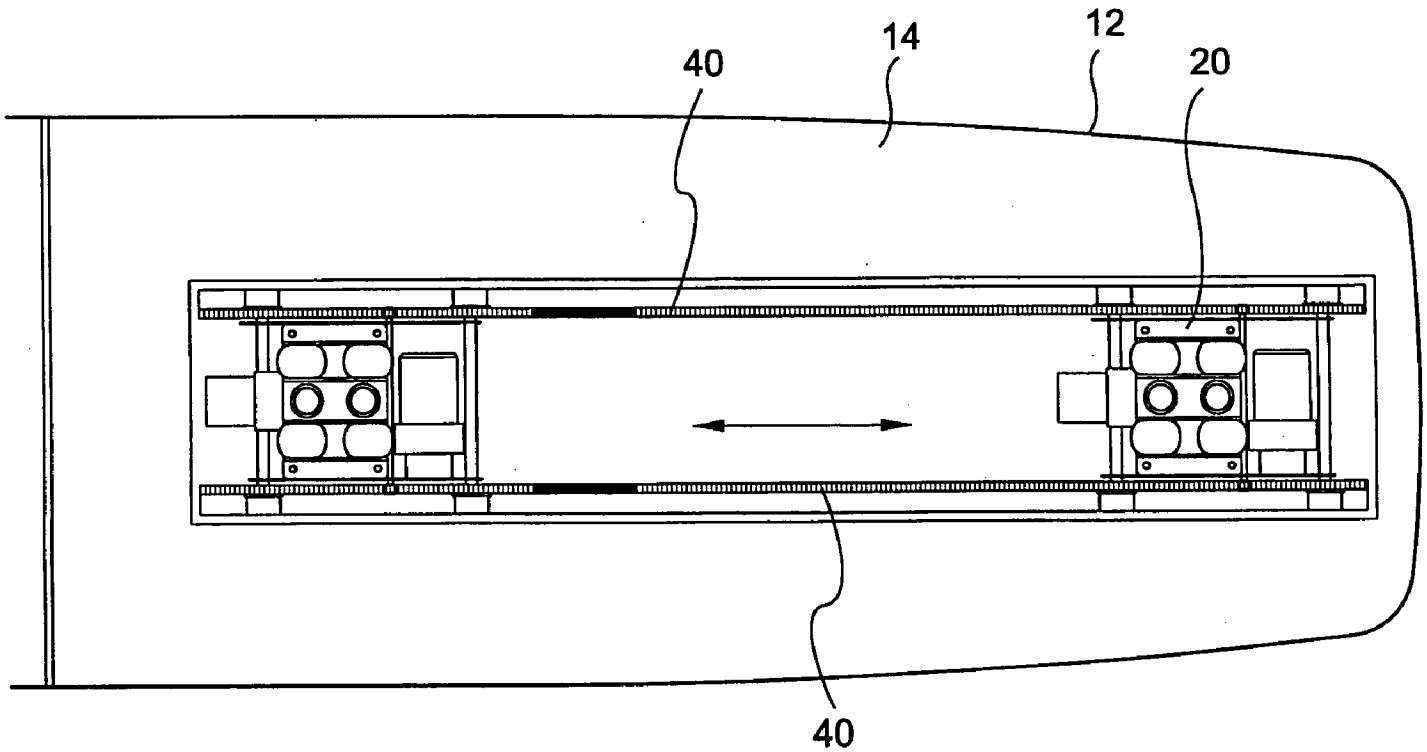
FIG. 4 is a partial plan view showing a second embodiment of the present invention.
Figure 5:
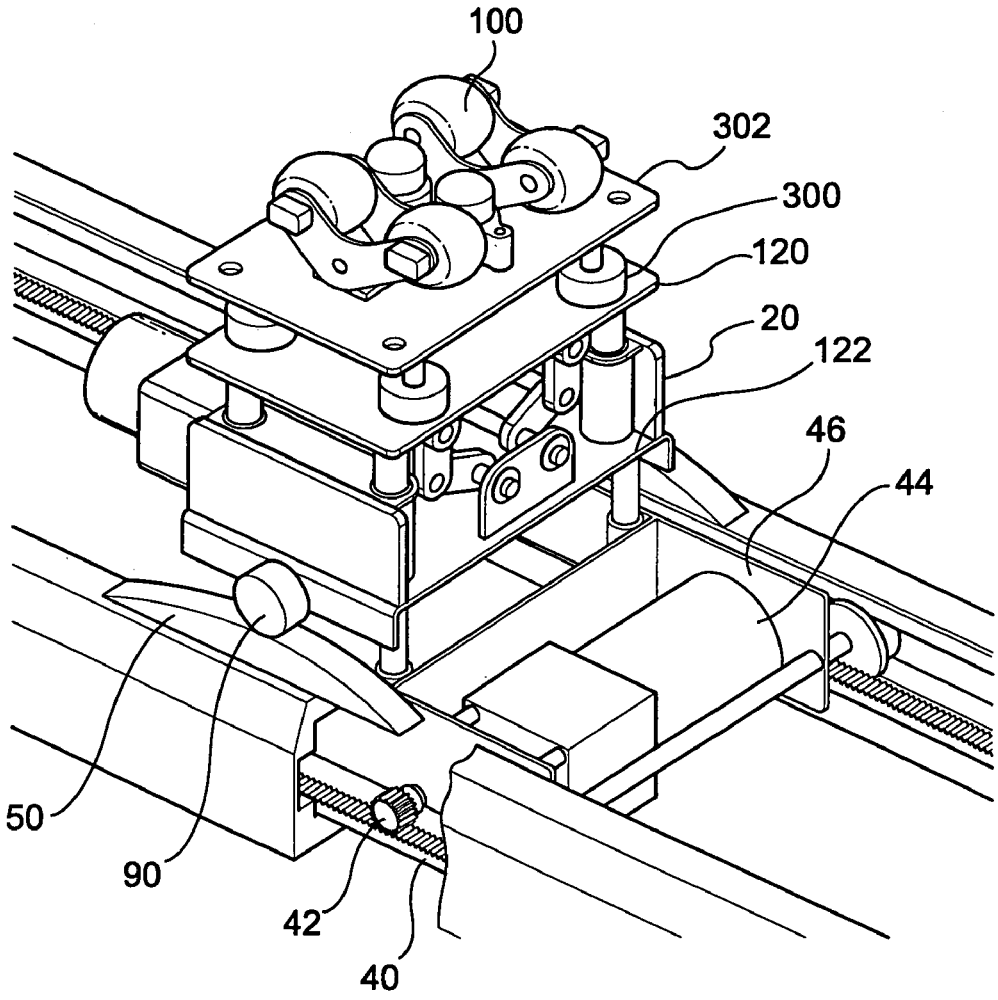
FIG. 5 is a partial perspective view showing the mechanism according to the second embodiment of the present invention.
Figure 6:
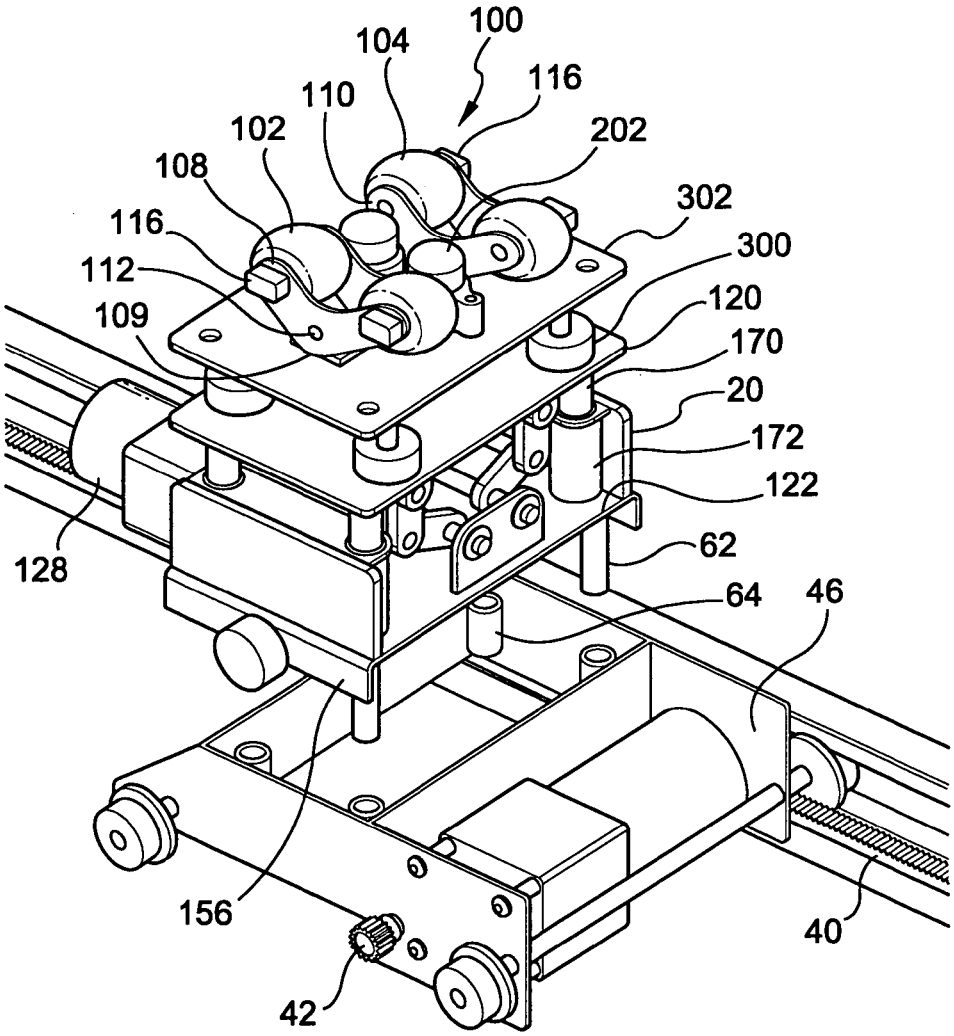
FIG. 6 is a partial exploded perspective view showing the rider, air shock absorbers and the lifter.

Meanwhile, FIGS. 4, 5 and 6 respectively illustrate the rack gear application for the horizontal reciprocation of the rider 18. As shown therein, the guide member 26 employing the rack gear application includes a pair of side rack gears 40 parallel to each other and lengthwisely provided in the base frame 12, a roller gear 42 perpendicular to the side rack gears 40, and a roller gear motor 44 fixed to the rider to power the roller gear 42. The roller gear 42 is rollably connected to a rider 46 and rotatably mounted on the side rack gears 40.

To accelerate massaging effect, the massager 10 includes one or more pairs of roller coasters 50 parallel to each other. The roller coasters 50 are attached to the base frame 12 and above the rider guide rollers 52 formed on each side of the rider 18 (refer to FIG. 3). The rider guide rollers 52 are rollably engaged to the base frame 12 to guide a horizontally reciprocal movement of the rider 18. That is, the roller coasters 50 are formed on each side of the base frame 12. Here, the roller coasters 50 each have a substantially waved top surface 54. It is preferred that the waved top surfaces 54 of the roller coasters 50 each substantially form a curvature of a human spinal cord.

In order to utilize the roller coasters 50, there are provided two coaster guide rollers 90 formed outwardly extending from each side of the lifter 20. The coaster guide rollers 90 enable the lifter 20 to make a roller coasting movement on and along the waved top surfaces 54 of the roller coasters 50.

Figure 7:
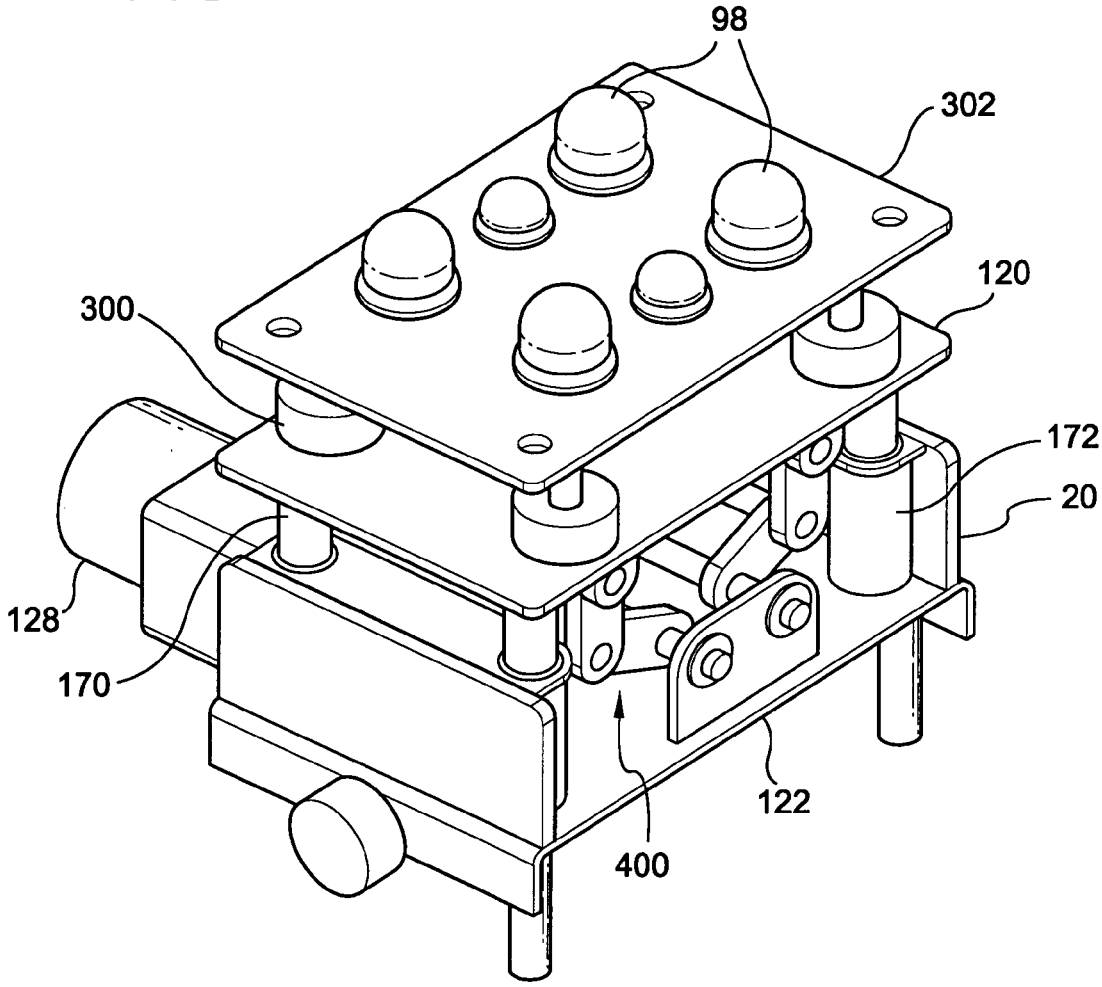
FIG. 7 is a perspective view of the lifter and the shock absorbers showing the operation of the lifter.
Figure 8:
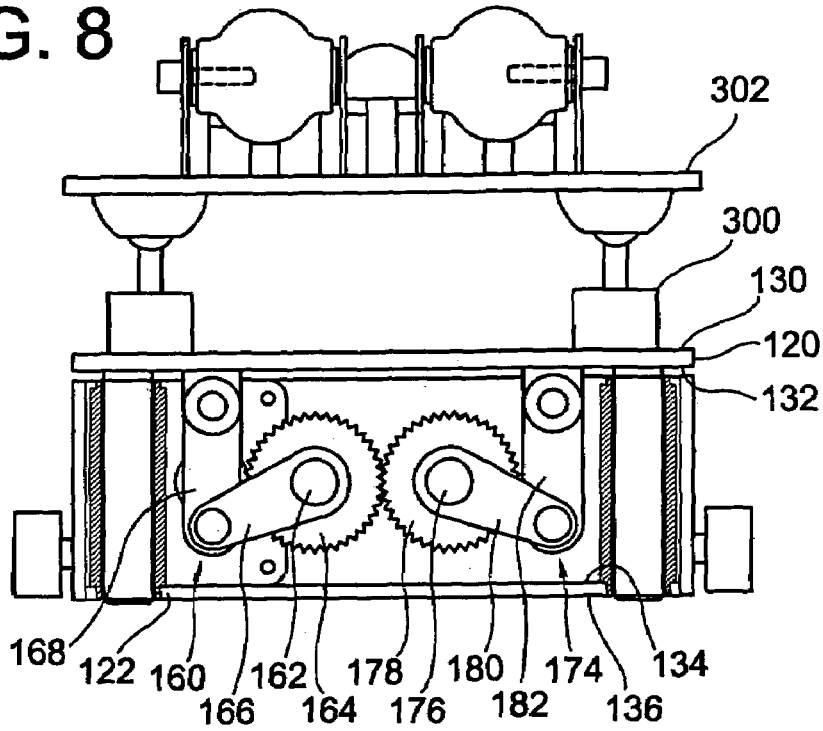
FIG. 8 is a front elevation view showing that the lifter is in its lowest position.
Figure 9:
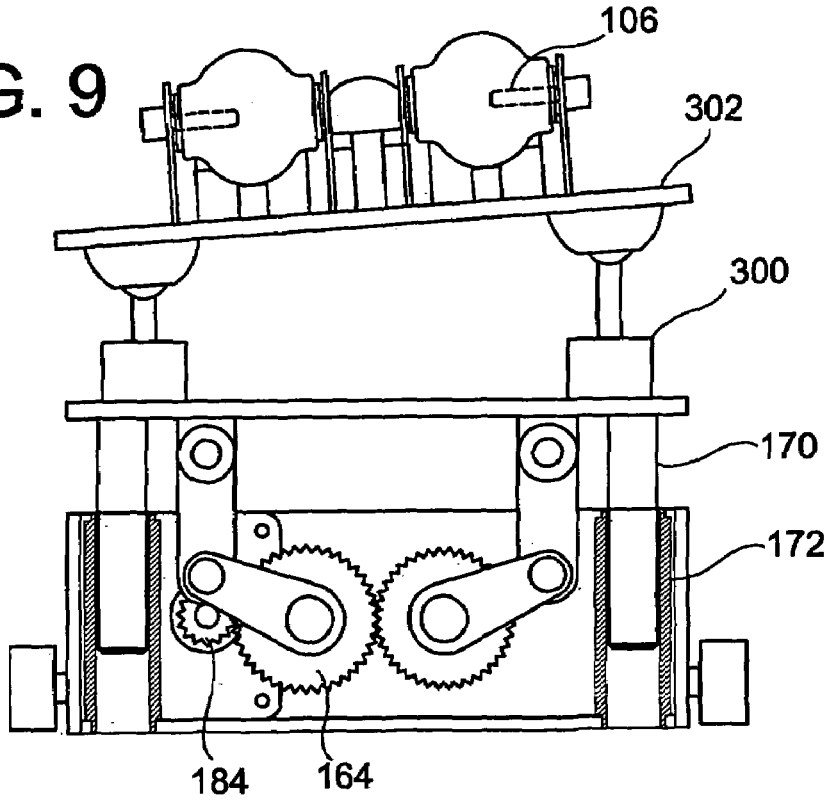
FIG. 9 is a front elevation view showing that the lifter is in its highest position.

As shown in FIGS. 7–9, the lifter 20 has a top plate 120 and a bottom plate 122, and a vertical actuator 400 that moves the top plate 120 up and down. The vertical actuator 400 includes a first link assembly 160, and a lifter motor 128. The top plate 120 has a top upper surface portion 130 and a top lower surface portion 132 (refer to FIG. 8). The bottom plate 122 has a bottom upper surface portion 134 and a bottom lower surface portion 136. The first link assembly 160 includes a gear shaft 162 rotatably attached to the bottom plate 122, a link gear 164 fixed to the gear shaft 162, a low link 166 fixed to the gear shaft 162, a high link 168 connecting between the low link 166 and the top plate 120. The lifter motor 128 rotates the link gear 164 either clockwise or counterclockwise direction, so that the rotation of the link gear 164 lifts or lowers the top plate 120 via the low link 166 and the high link 168.

Four lifter guides 170 extend downward from the top lower surface portion 132 of the top plate 120 at the four corners of the top plate 120. Four lifter guide bushes 172 extend upward from the bottom upper surface portion 134 of the bottom plate 122 to releasably receive the lifter guides 170.

The lifter may further include a second link assembly 174 for balanced and more stabilized lifting and lowering operations. The second link assembly 174 includes a gear shaft 176 rotatably attached to the bottom plate 122, a link gear 178 fixed to the gear shaft 176, a low link 180 fixed to the gear shaft 176, a high link 182 connecting between the low link 180 and the top plate 120. The link gear 164 of the first link assembly 160 and the link gear 178 of the second link assembly 174 engage with each other so that when one rotates clockwise, the other rotates counterclockwise, and vice versa. The first link assembly 160 and the second link assembly 174 are positioned symmetrical with each other, as shown well in FIG. 8. Therefore, when the lifter motor 128 rotates the link gear 164 of the first link assembly 160, the first link assembly 160 and the second assembly 174 together lift or lower the top plate 120.

The link gears 164, 178 of the first and second link assemblies 160, 174 are spur gears having identical dimensions. The lifter motor 128 includes a driving spur gear 184 that engages with the link gear 164 of the first link assembly 160.

Referring back to FIG. 6, elongated guides 62 downwardly extend from the bottom lower surface portion 136 of the lifter 20, and guide bushes 64 are upwardly formed on the rider 18 to releasably receive the elongated guides 62 so as to stabilize the roller coasting movement of the lifter 20 along the roller coasters 50. Preferably, the elongated guides 62 are shaped in pins.

Two side coasting walls 156 extend downward from two opposing ends of the bottom plate 122, and the coaster guide rollers 90 are rotatably attached to the side coasting walls 156.

A massage plate 302, on which the massage bumps 100 are installed, is provided. The air shock absorbers 300 are vertically installed between the massage plate 302 and the top plate 120.

Figure 10:
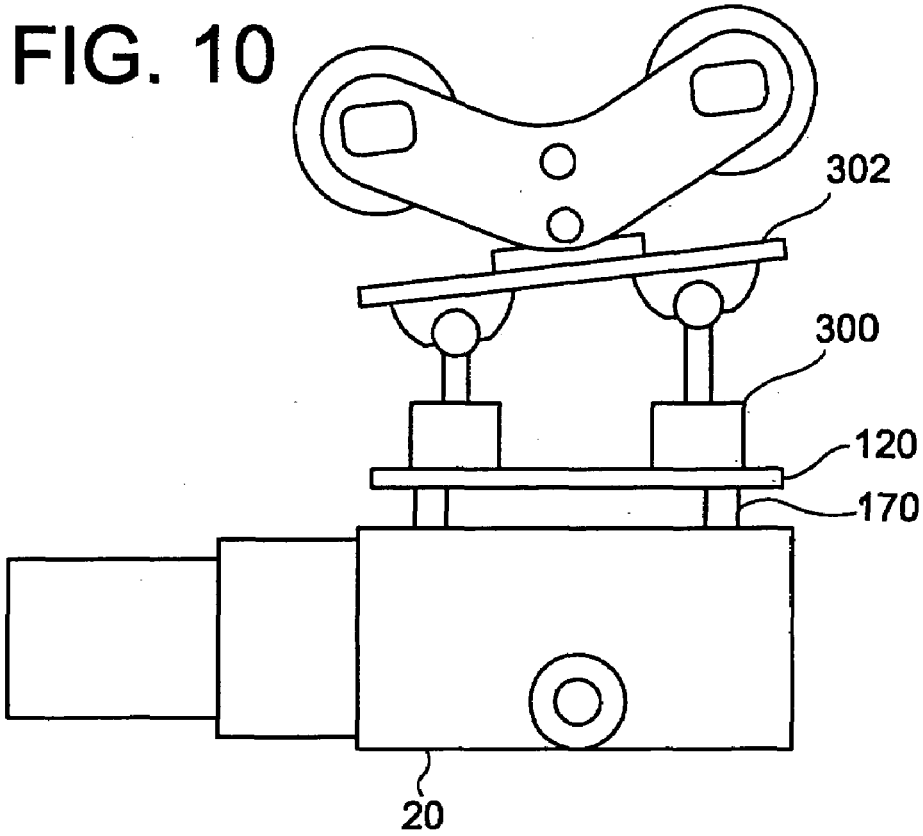
FIG. 10 is a side elevation view of the lifter and the shock absorbers.
Figure 11:
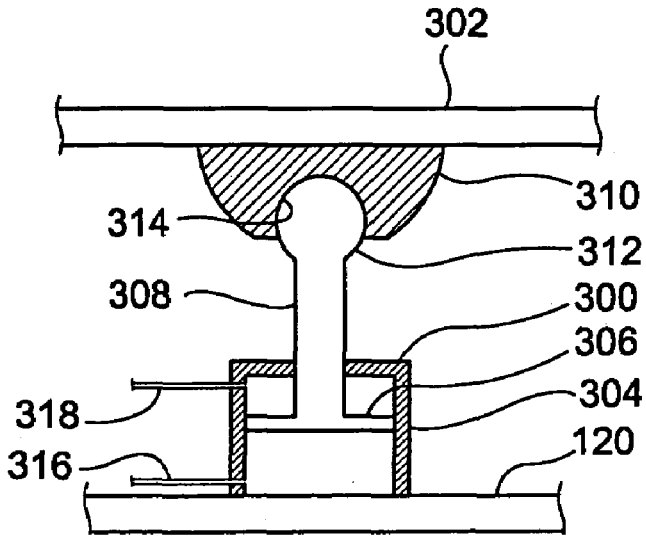
FIG. 11 is a cross-sectional view of the air shock absorber.

FIGS. 10 and 11 show the air shock absorber 300. The air shock absorber 300 has a hollow cylinder 304, a plunger 306 that is moved reciprocally in the cylinder 304, a shaft 308 fixed to the plunger 306 and protruding out of the cylinder 304, and a bracket 310. The free end 312 of the shaft 308 is shaped as a ball, and the bracket has a semi-spherical recess 314 so that the end 312 of the shaft 308 and the recess 314 of the bracket form a ball and socket joint. The cylinder 304 is fixed to the top plate 120, and the bracket 310 is fixed to the massage plate 302. While the top plate 120 is parallel with the top panel 14, the ball and socket joint enables arbitrary tilting of the massage plate 302 with respect to the top plate 120 as shown in FIGS. 9 and 10. In this way, the air shock absorbers 300 compensate the difference between the body contour of each of different users and the movement of massage bumps 100 performed by the rider 18 and the lifter 20.

Pressurized air is provided into the cylinder 304 through a flow-in pipe 316 to lift the plunger 306 upward against the force applied by the massage bumps 100. A flow-out pipe 318 is provided to make the space above the plunger 306 within the cylinder 304 to be communicated with outside.

The top plate 120 and the massage plate 302 are rectangular. Four air shock absorbers 300 are positioned near the four corners of the top plate 120.

In order to finally apply the gear-operated link lifting mechanism to a patient lying on the massager 10, there are provided the massage bumps 100 attached to the top upper surface portion 130 of the lifter 20 and moving vertically and/or horizontally along the elongated top opening 16 of the elongated top panel 14 of the base frame 12. Optionally, a pad 17 may be provided to cover the massage bumps 100 and the elongated top opening 16 of the base frame 12.

FIG. 9 shows that the top plate 120 is in its uppermost position, that is, the massage bumps 100 are in their topmost position. FIG. 8 shows that the top plate 120 is in its lowermost position, that is, the massage bumps 100 are in their lowermost position.

The massage bumps 100 are preferably partitioned to first and second pairs 102, 104(refer to FIG. 6). Here, the first pair bumps 102 are aligned parallel to the second pair bumps 104. The massage bumps 100 each include a heater 106 which can be a heating lamp generating heat and infrared rays (refer to FIG. 9).

To further improve massaging effect, there are provided first and second bump holders 108, 110 propping and maintaining the first and second pair bumps 102, 104 above the massage plate 302. For a better massaging result, the first and second bump holders 108, 110 are tapered toward each lower end 109 thereof, and a first engagement member 112 to rockingly engage the lower ends 109 of the bump holders 108, 110 to the massage plate 302, and a second engagement member 116 to rollingly engage the massage bumps 100 thereto, are provided. The massage bumps 100 may be roller balls formed of precious stone such as jade. In FIG. 6, fixed massage bumps 202 are provided between the massage bumps 100.

FIG. 7 shows alternate massage bumps 98. The massage bumps 98 are round projections that are fixed to the top upper surface portion 130 of the lifter 20.

Although the invention has been described in considerable detail, other versions are possible by converting the aforementioned construction. Therefore, the scope of the invention shall not be limited by the specification specified above.

What is claimed is:

1. A lie-down massager, comprising:

a) a base frame having an elongated top panel, wherein an elongated top opening is formed centrally and lengthwise through the elongated top panel;

b) a rider provided below the elongated top panel of base frame;

c) a guide member movably engaged between the base frame and the rider so as to enable the rider to make a horizontally reciprocal movement relative to the base frame;

d) a lifter, wherein the lifter comprises a top plate, a bottom plate, a vertical actuator that moves the top plate up and down;

e) one or more air shock absorbers;

f) massage bumps attached on the lifter via the air shock absorbers and moved by the lifter vertically and/or horizontally along the elongated top opening of the elongated top panel of the base frame; and g) a massage plate, wherein the massage bumps are installed on the massage plate, and the air shock absorbers are vertically installed between the massage plate and the top plate, wherein each of the air shock absorbers has a hollow cylinder fixed to the top plate, a plunger that is moved reciprocally in the cylinder, a shaft fixed to the plunger and protruding out of the cylinder, and a bracket fixed to the massage plate, wherein a free end of the shaft is shaped as a ball, and the bracket has semi-spherical recess so that so that the free end of the shaft and the recess of the bracket form a ball and socket joint.

2. The lie-down massager of claim 1 further comprising a pad covering the massage bumps and the elongated top opening of the base frame.

3. The lie-down massager of claim 1 wherein the massage bumps are partitioned to first and second pairs, wherein the first pair bumps are aligned parallel to the second pair bumps.

4. The lie-down massager of claim 3 further comprising:

a) first and second bump holders propping and maintaining the first and second pair bumps above the top plate of the lifter, wherein the first and second bump holders are tapered toward each lower end thereof; and b) a first engagement member to rockingly engage the lower ends of the bump holders to the top plate of the lifter.

5. The lie-down massager of claim 4 further comprising a second engagement member to rollingly engage the massage bumps thereto.

6. The lie-down massager of claim 4 wherein the massage bumps are roller balls.

7. The lie-down massager of claim 6 wherein the roller balls are formed of jade.

8. The lie-down massager of claim 1 wherein each of the massage bumps includes a heater.

9. The lie-down massager of claim 8 wherein the heater is a heating lamp generating heat and infrared rays.

10. The lie-down massager of claim 1 wherein the guide member comprises:

a) one or more roller gear engaged to and powered by a roller gear motor, wherein the roller gear motor is fixed to the rider; and b) one or more side rack gears parallel to each other and provided lengthwise in the base frame;

wherein the roller gears are rollably connected to the rider and rotatably mounted on the side rack gears.

11. The lie-down massager of claim 1 wherein the guide member comprises:

a) rider guide rollers provided on each side of the rider, wherein the rider guide rollers are rollably engaged to the base frame to guide a horizontally reciprocal movement of the rider;

b) a pair of pulleys linked by a rope and respectively mounted in a front end portion and a rear end portion of the base frame, wherein a predetermined portion of the rope is fixedly attached to the rider so that the pulley rotation enables the rider to generate a horizontally reciprocal movement of the rider.

12. The lie-down massager of claim 11 wherein the pulleys are relatively twisted by 90 degrees against each other.

13. The lie-down massager of claim 1 further comprising:

a) a pair of roller coasters parallel to each other, wherein the roller coasters are attached to the base frame, wherein each of the roller coasters has a substantially waved top surface; and b) coaster guide rollers formed outwardly extending from each side of the lifter, wherein the coaster guide rollers enable the lifter to make a roller coasting movement on and along the waved top surfaces of the roller coasters.

14. The lie-down massager of claim 13 wherein each of the waved top surfaces of the roller coasters substantially forms a curvature of a human spinal cord.

15. The lie-down massager of claim 13 wherein the lifter further comprises a plurality of elongated guides extending downward from the lifter, and the rider further comprises a plurality of guide bushes upwardly formed on the rider to releasably receive the elongated guides so as to stabilize the roller coasting movement of the lifter along the roller coasters.

16. The lie-down massager of claim 15 wherein the elongated guides are shaped in pins.

17. The lie-down massager of claim 1 wherein the number of the air shock absorbers is four, wherein the top plate is rectangular, and wherein the air shock absorbers are positioned near the four corners of the top plate.

* * * * *